United States Patent [19]

Brewington et al.

[11] Patent Number: 4,764,841

[45] Date of Patent: Aug. 16, 1988

[54] TONER CHARGING APPARATUS WITH COATED TONER TRANSPORT MEMBERS

[75] Inventors: Grace T. Brewington; Dan A. Hays, both of Fairport; William H. Wayman, Ontario, all of N.Y.

[73] Assignee: Xerox Corporation, Stamford, Conn.

[21] Appl. No.: 681,750

[22] Filed: Dec. 14, 1984

[51] Int. Cl.[4] ..... G03G 15/06

[52] U.S. Cl. ..... 361/226; 355/3 DD; 118/651; 118/653; 118/658

[58] Field of Search ..... 361/225, 226; 355/3 DD, 355/3 R; 118/644, 651, 653, 657, 658

[56] References Cited

U.S. PATENT DOCUMENTS

| | | | |
|---|---|---|---|
| 3,863,603 | 2/1975 | Buckley et al. | 118/658 |
| 4,003,333 | 1/1977 | Eichorn | 118/653 |
| 4,092,165 | 5/1978 | Andrus et al. | 355/3 DD |
| 4,331,754 | 5/1982 | Stephan | 430/102 |
| 4,382,420 | 5/1983 | Ohnuma et al. | 118/651 |
| 4,383,497 | 5/1983 | Tajima | 118/651 |
| 4,459,009 | 7/1984 | Hays et al. | 355/3 DD |
| 4,505,573 | 3/1985 | Brewington | 355/3 DD |
| 4,522,907 | 6/1985 | Mitsuhashi et al. | 361/226 |
| 4,618,241 | 10/1986 | Hays et al. | 355/3 DD |

*Primary Examiner*—L. T. Hix
*Assistant Examiner*—D. Rutledge
*Attorney, Agent, or Firm*—E. O. Palazzo

[57] ABSTRACT

An apparatus for charging insulating toner particles comprised, in operative relationship, of a means for charging insulating toner particles and a means for transporting insulating toner particles, said means for charging and said means for transporting biased to a predetermined potential wherein the transporting means contains therein a coating selected from the group consisting of a chlorotrifluoroethylene vinyl chloride copolymer, styrene copolymers, and silicone resins with conductive particulate particles therein.

16 Claims, 2 Drawing Sheets

TONER CHARGING APPARATUS WITH COATED TONER TRANSPORT MEMBERS

BACKGROUND OF THE INVENTION

The present invention is generally directed to toner charging apparatuses, and more specifically, the present invention is directed to a toner charging apparatus containing coated toner transporting members. The apparatus of the present invention is useful in a number of imaging processes including electrostatographic imaging systems comprised, in operative relationship, of a means for simultaneously metering and charging nonmagnetic insulating toner particles.

The development of images by various methods, including electrostatographic means, is well known. In several of these methods, toner particles are deposited on an electrostatic latent image present on an insulating surface, such as selenium, utilizing, for example, cascade development, magnetic brush development, powder cloud development, and touchdown development. In view of several disadvantages associated with two-component systems, considerable effort has been directed to designing processes which utilize toner particles only, reference for example U.S. Pat. No. 2,846,333. This patent discloses a single component developer composition comprised of toner resins, colorants, and magnetic materials.

In many of the single component development processes, conductive toner particles are selected, and imagewise toner deposition onto the photoconductive member is obtained by induction charging of the toner particles. Electrostatic transfer of conductive toner particles of plain bond paper is, however, usually inefficient as the charge on the toner particles can be reversed by induction charging from the paper during the transfer step. Accordingly, electrophotographic systems wherein conductive single component toner particles are used can require a special overcoated insulating paper to achieve sufficient electrostatic toner transfer. Furthermore, in single component processes with conductive toner particles the control of undesirable background, or background suppression, cannot usually be achieved with electrostatic forces as the toner particles are inductively charged, and deposited on the image bearing member, which is not the situation with two-component developer processes where control of background development is accomplished by electrostatic forces acting on the triboelectrically charged toner particles, causing these particles to be directed away from image bearing members.

Recently, there has been disclosed an efficient, single component, economical, simple process, and apparatus for the development of latent electrostatic images wherein insulative, nonmagnetic, or color toner particles are appropriately charged; and there is obtained two-component image quality utilizing a single component development apparatus. In this system, as detailed hereinafter, and as described in U.S. Pat. No. 4,459,009, the disclosure of which is totally incorporated herein by reference, there is selected a charging roll means which simultaneously meters and charges toner particles. A donor electrode serves to transport the toner particles, which electrode can be comprised of numerous suitable materials, including for example, aluminized Mylar overcoated with a polymer containing carbon black, electroformed nickel, or a carbon black loaded extruded polymer. While these materials may be satisfactory for their intended purposes, there continues to be a need for new coatings wherein the surface topography thereof is stable, and textured to assist in the transporting of toner particles from the donor electrode to the imaging member.

Furthermore, known prior art coatings such as Krylon coated onto a nickel substrate, although suitable for their intended purposes, are not scratch resistant over extended time periods. Thus, these coatings permit scratches to form on the toner transporting means, which in turn adversely affects image copy quality. Additionally, toner particles appear to permanently adhere to the surface of transporting members with Krylon coatings, which adhesion results in undesirable high background deposits on the resulting developed images.

There is also described in U.S. Pat. No. 4,505,573, the disclosure of which is totally incorporated herein by reference, a transporting means for insulating toner particles comprised of a suitable substrate and a coating thereover of a low surface energy, wear resistant material. More specifically, there is disclosed in this patent application an insulating toner transporting system comprised of a substrate, and a coating thereover of a fluoropolymer. The improved toner transporting means of the '573 are particularly useful in an apparatus for charging toner particles comprised in operative relationship of a means for charging insulating toner particles, and a means for transporting insulating toner particles wherein the means for charging and the means for transporting are biased to a predetermined potential.

Accordingly, in one embodiment, the invention of the referred to '573 is directed to an apparatus for a charging insulating toner particles comprised, in operative relationship, of a means for charging insulating toner particles; and a means for transporting insulating toner particles, the means for charging and the means for transporting being biased to a predetermined potential wherein the transporting means contains a mixture of a fluoropolymer coating, and conductive particles such as carbon black. In accordance with the present invention, alternative coatings for the transporting means are provided.

SUMMARY OF THE INVENTION

It is an object of the present invention to provide alternative coatings for toner transporting means.

In a further object of the present invention there is provided an alternative donor surface for transporting toner particles in single component development systems.

In another object of the present invention there is provided toner transporting sleeves, or rolls, including rigid toner transporting means, and toner transporting belts with certain coatings thereover.

In yet another object of the present invention there is provided donor transporting sleeves, rolls, or belts, with specific fluoropolymer coatings, coatings of styrene copolymers, and specific silicone coatings thereover.

In yet a further object of the present invention there is provided donor transporting sleeves or rolls, including rigid toner transporting means, and toner transporting belts useful in single component development systems, particularly those incorporated into a system with a metering/charging means.

These and othr objects of the present invention are accomplished by the provision of a transporting means for insulating toner particles comprised of a suitable substrate, and a coating thereover. More specifically, the present invention is directed to an insulating toner transporting means comprised of a substrate, and a coating thereover selected from the group consisting of specific fluoropolymers, styrene copolymers, and silicone resins. The coated toner transporting means of the present invention are particularly useful in an apparatus for charging toner particles comprised in operative relationship of a means for charging insualting toner particles and a means for transporting insulating toner particles, wherein the means for charging and the means for transporting are biased to a predetermined potential, reference U.S. Pat. Nos. 4,368,970; 4,394,429; and U.S. pending application U.S. Ser. No. 588,181, now U.S. Pat. No. 4,618,241 the diclosure of each of these documents being totally incorporated herein by reference.

Accordingly, in one embodiment the present invention is directed to an apparatus for charging, insulating toner particles comprised, in operative relationship, of a means for charging insulating toner particles; and a means for transporting insulating toner particles, the means for charging and the means for transporting being biased to a predetermined potential wherein the transporting means contains a mixture of certain fluoropolymer coatings, styrene polymers, or silicone resins, and conductive particles such as carbon black.

In another embodiment of the present invention there is provided an apparatus for simultaneously metering and charging nonmagnetic insulating toner particles comprising, in operative relation, a metering/charging roll means with a triboelectrically active coating present on the metering/charging roll means; a doctor blade means for the metering/charging roll means; toner supply reservoir means containing therein weakly charged insulating toner particles possessing about an equal number of positively charged toner particles, and negatively charged toner particles; a transporting toner belt means comprised of a nickel sleeve containing on its entire surface a coating of specific fluoropolymers, styrene copolymer resins, or silicone resins; a voltage source means for the metering/charging roll means; a voltage source means for the nickel sleeve means; and the metering/charging roll means moving in a direction opposite to the direction of the movement of the transport donor sleeve means.

DESCRIPTION OF THE PREFERRED EMBODIMENTS

Figure 1:
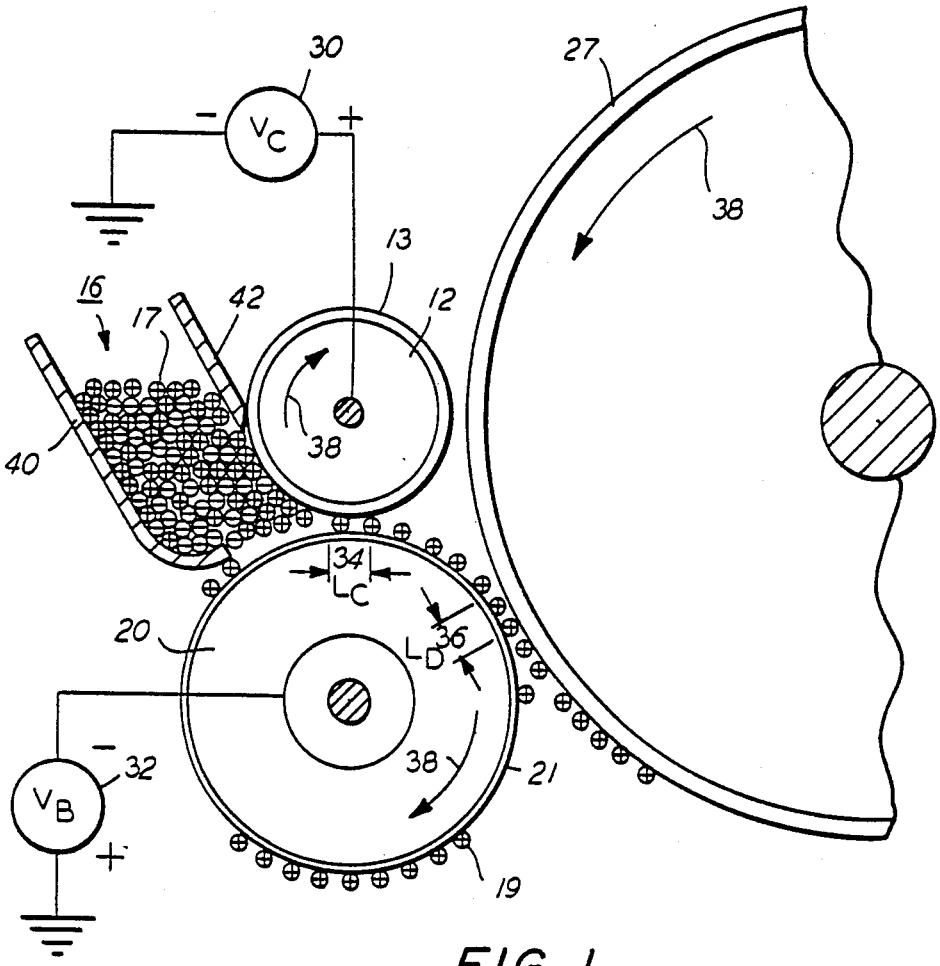
Figure 2:
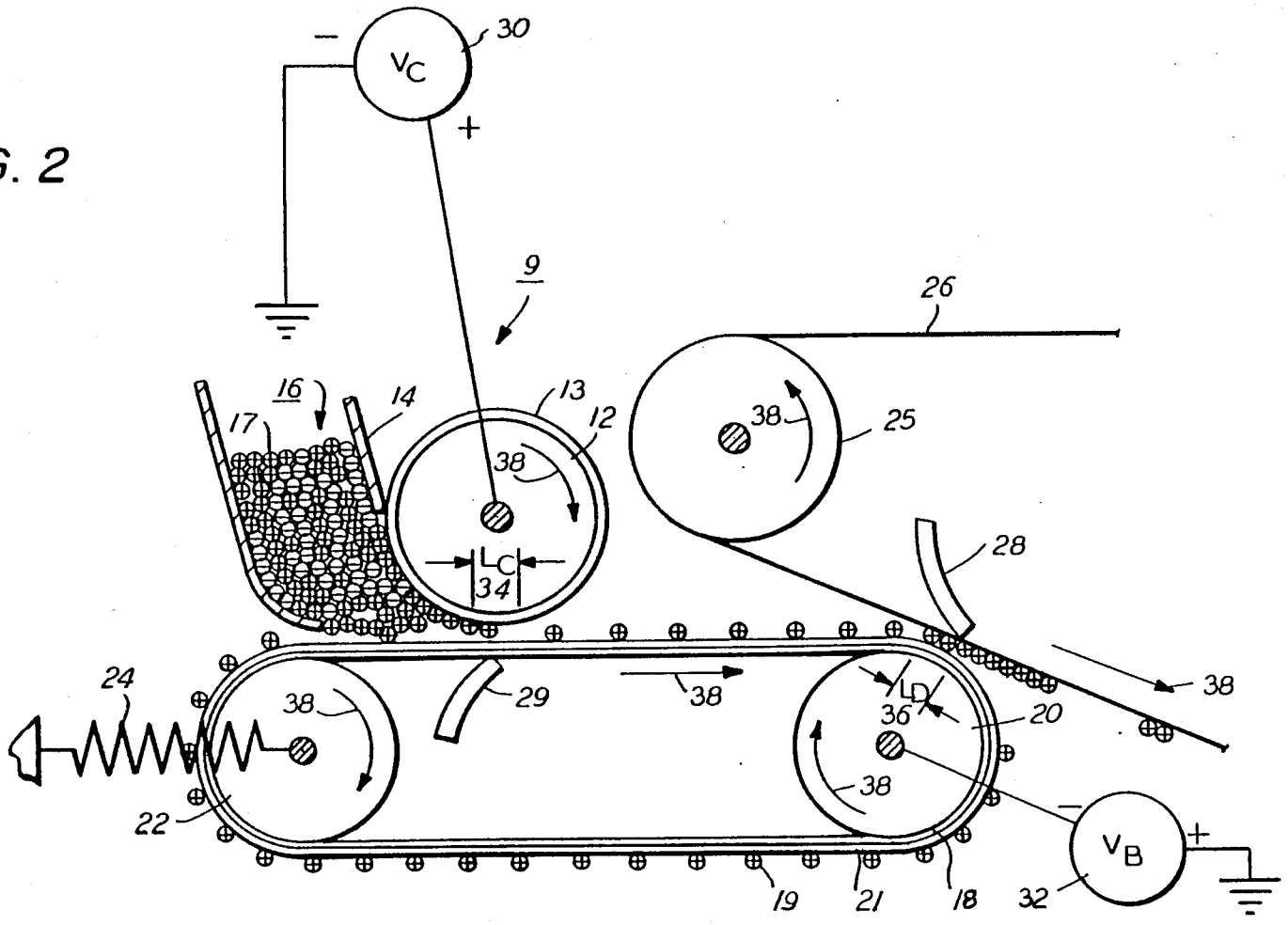

The apparatus of the present invention and various alternative embodiments will now be described with reference to the Figures wherein:

FIG. 1 is a schematic view of an embodiment of the apparatus of the present invention; and FIG. 2 is a schematic view of another embodiment of the apparatus of the present invention.

The apparatus of the present invention comprised of toner transporting means inclusive of nickel, or a nickel substrate with coatings selected from the group consisting of specific fluoropolymers, styrene copolymer resins, and silicone resins; are useful in various imaging systems, especially these wherein there is selected a single component development apparatus containing a metering/charging roll means, reference U.S. Pat. No. 4,459,009, the disclosure of which has been totally incorporated herein by reference. Accordingly, there is illustrated in FIG. 1 a metering/charging roll means 12 with a triboelectrically active coating thereon 13; a toner supply reservoir means 16 containing therein weakly charged insulating non-magnetic toner particles 17 comprised of about an equal number of positively charged toner particles and negatively charged toner particles; a compliant donor roll means 20 containing thereon the fluoropolymer coating vinyl chloride/-chlorotrifluoroethylene 21, available as FPC 461; a rigid photoreceptor means 27; a doctor blade seam means 42; a wiper blade seal means 40; a voltage source 30 ($V_C$), a voltage source 32 ($V_B$); a charging zone 34 ($L_C$); a development zone 36 ($L_D$) with the components moving in the direction of the arrows 38. The metering/charging roll may be comprised of cores without triboelectrically active coatings thereover, reference U.S. Ser. No. 588,181, the disclosure of which has been totally incorporated herein by reference.

Figure 1B:
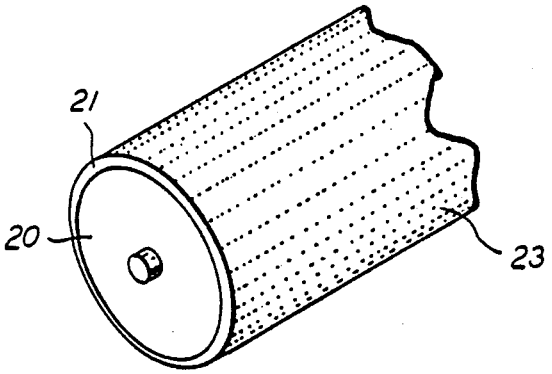

With further reference to FIG. 1, the toner particles are transported by supplying weakly charged toner particles 17 to the charging nip 34, situated between the metering/charging roll means 12 and the compliant donor roll means 20 consisting of, for example, a roll containing thereon the fluoropolymer coating 21. As a result of the movement in opposite directions of roll means 12, and roll means 20, toner particles 17 contact coating 13 in the charging zone 34 causing these particles to acquire a positive charge thereon. The positively charged toner particles 19 are then transported by the compliant donor roll means 20, which means in a preferred embodiment is preferably textured 23, reference FIG. 1B with, for example, particulate fillers such as silica, to a rigid imaging member 27 or flexible imaging member, not shown, where they are attracted thereto in the development zone 36. Unused toner particles are returned to the toner reservoir by roll means 20 as illustrated.

Illustrated in FIG. 2 is another embodiment of the present invention, generally designated 9, comprising a metering/charging roll means 12 with a triboelectrically active coating 13 thereon, a doctor blade seal means 14, a toner supply means 16, with toner particles 17 possessing an approximately equal number of weakly charged positive and weakly charged negative toner particles, a doner means 18 with silicone resin coating thereon 21, positively charged toner particles 19, a drive roll means 20, an idler roll means 22, a tensioning means 24, a flexible imaging member means 26, a roll means 25, a pressure blade means 28, a pressure blade means 29 for the metering/charging zone 34, a voltage source 30, a voltage source 32, a charging zone 34, a development zone 36 with the components moving in the direction as shown by the arrows 38.

In summary, with reference to FIG. 2, the weakly charged insulating toner particles 17 are deposited on the silicone coating 21 of the donor belt means 18 as a result of movement of the components, gravitational forces, and the electrostatic force from voltage source means 30, wherein the toner particles are brought into rubbing contact with the metering/charging roll means 12 in the charge zone 34, thus resulting in positively charged toner particles 19. The donor belt 18 makes a tangential contact with roll means 12, and is self-spaced therefrom by insulating toner particles with the nip pressure being supplied by compliant blade means 29 positioned on the backside of the belt 18. Positively charged toner particles 19 are then transported on the donor belt surface coating 21, until contacting the flexible imaging member 26 in the development zone 36 $L_D$, wherein the particles are then transferred to the imaging member which has been charged negatively. Pressure blade 28 provides sufficient force to ensure contact of the positively charged toner particles with the imaging member 26 for the distance 36. Unused positively charged toner particles are, as shown, returned to the toner reservoir 16 for reuse in the system.

The core of metering/charging roll means 12 can be solid or hollow, and can be comprised of numerous known suitable materials including, for example, aluminum, steel, iron, nickel, polymeric materials, and the like, providing they are of sufficient strength to be operable in the system. Generally, the core which is preferably nickel is of a radius of from about 0.25 inches to about 2 inches, and preferably is from about 0.5 inches to about 1 inch. Idler roll means 22 can be comprised of the same materials as roll 12, this roll ranging in diameter of from about 0.25 inches to about 1 inch. Also, the metering/charging roll can be comprised of materials as illustrated in the copending application Ser. No. 588,181.

The triboelectric coating 13 present on the metering/charging roll means 12 can be selected from numerous materials known in the art including many of the same compounds used for coating carrier particles. This coating is selected according to the charge that is desired to be imparted to the toner particles. Thus, if it is desired to impart a positive charge to the toner particles, a coating capable of acquiring negative charges thereon is elected, these coatings including various electronegative materials such as polymers, including copolymers of chlorotrifluoroethylene and vinyl chloride commercially available as FPC 461. Examples of other electronegative materials that can be selected include highly halogenated polymers, such as polyvinylidene fluoride, polytetrafluoroethylenes, perfluoroalkoxylated ethylenes, fluorinated ethylenepropylene polytetrafluoroethylene copolymers, polyvinylchlorides, and the like. In those situations where it is desired to impart a negative charge to the insulating toner particles, a coating capable of acquiring a positive charge thereon is selected, including various electropositive materials such as polyvinylpyridines, terpolymers of methacrylates such as polymethylmethacrylate, polystyrene/n-butylmethacrylate, silane terpolymers, polycaprolactum, and the like. Additionally, there can be selected as coatings 13 materials analogous to thermoplastic toner resin as described hereinafter with charge control agents for the purpose of imparting a positive or negative charge to the toner particles. Various suitable charge control agents can be used including alkylpyridinium halides, such as cetylpyridinium chloride, quaternary ammonium compounds, organic sulfate compounds, hydrozonium compounds, and the like. Generally, the charge enhancing additives are present in an amount of from about 0.1 weight percent to about 10 weight percent.

The thickness of coating 13 is dependent on many factors including economical considerations, however, this coating is generally of a thickness of from about 2 micrometers to about 125 micrometers, and preferably is of a thickness of from 2 micrometers to about 75 micrometers.

The compliant donor roll means 20 generally consists of an elastic core, such as a polyurethane foam or silicone rubber covered with a seamless, flexible and conductive sleeve of, for example, electroformed nickel; or an extruded polymer coated with a polymer containing carbon black. The conductive sleeve, can also be overcoated with materials described herein with reference to the donor means 18.

Drive roll means 20 and idler roll means 22 can be comprised of conductive rubber materials, while the transporting donor means 18, reference FIG. 2, can be comprised of numerous suitable materials including, for example, aluminized Mylar overcoated with a fluoropolymer or a silicone resin; a seamless electroformed nickel belt overcoated with a fluoropolymer, a styrene copolymer, or a silicone resin; a seamless extruded polymer sleeve overcoated with a polymer containing a conductive additive such as carbon black, which sleeve is overcoated with a fluoropolymer, a styrene copolymer, or a silicone resin; or a bare electroformed nickel sleeve overcoated with a fluoropolymer, a styrene copolymer, or a silicone resin processed in such a manner so as to impart a texture to the surface thereof. The overcoating polymers can be modified by adding thereto from about 5 to about 5.5 percent by weight of conductive substances such as carbon black, and 10 percent by weight of a silica filler functioning as a texturizing agent. Other amounts of modifying substances, and texturing agents may be used providing the objectives of the present invention are accomplished.

Illustrative examples of the image bearing member means 26 and 27 include inorganic and organic photoreceptor materials inclusive of amorphous selenium, selenium alloys including alloys of selenium-tellurium-arsenic, cadmium sulfide, zinc oxide, polyvinylcarbazole; layered flexible organic photoreceptors inclusive of those with an injecting contact of carbon dispersed in a polymer, a photogenerating layer which in turn is overcoated with a charge transport layer, and an overcoating of an insulating organic resin, reference U.S. Pat. No. 4,251,612, the disclosure of which is totally incorporated herein by reference. Also included within the scope of the present invention are flexible imaging members comprised of a substrate, an aryl amine transport layer and a photogenerating layer, reference U.S. Pat. No. 4,265,990, the disclosure of which is totally incorporated herein by reference.

Other organic photoreceptor materials include 4-dimethylaminobenzylidene, benzhydrazide; 2-benzylidene-amino-carbazole, (2-nitrobenzylidene)-p-bromoaniline; 2,4-diphenyl quinazoline; 1,2,4-triazine; 1,5-diphenyl-3-methyl pyrazoline 2-(4'-dimethyl-amino phenyl) benzoxazole; 3-amino-carbazole; polyvinylcarbazole-trinitrofluoroenone charge transfer complexes; phthalocyanines and mixtures thereof. Generally, positively charged toner compositions are selected when the imaging member is charged negatively as is the situation with most organic photoreceptors, while negatively charged toner particles are selected when the imaging member is charged positively, as is the situation with most inorganic photoreceptors, such as selenium.

Illustrative examples of fluoropolymer coatings that can be selected for the apparatus of the present invention include polyvinylidene fluoride available as Kynar from Pennwalt Chemical; ethylene chlorotrifluoroethylene copolymers; ethylene tetrafluoroethylene copolymers available as Halon from Allied Chemical; chlorotrifluoroethylene and vinyl chloride copolymers available from Firestone Plastics as FPC 461.

Illustrative examples of silicone resin coatings that can be selected for the apparatus of the present invention include DOW Corning 1-2531, Vestar, Q-6-2230, R-4-3117, Syl-off 23, Syl-off 294, 804 and 840; Owen Illinois T650, and T100; and General Electric SS4310, and SR6427.

Illustrative examples of styrene copolymer coatings that can be selected for the apparatus of the present invention include styrene methacrylates, inclusive of styrene butylmethacrylate, styrene butadiene polymers, and the like.

In one embodiment of the present invention, the specific coatings preferred are those with the following properties and characteristics:

1. A volume resistivity in the range of $10^6$ and $10^{10}$ ohm-cm.
2. A residual surface potential of less than about 5 volts.
3. A surface texture with peak to peak variations of 0.5 micrometers to 10 micrometers, and a spatial variation ranging from 5 micrometers to 100 micrometers.
4. A sufficient non-tackiness allowing the toner particles to be released from the transporting member surface in the development zone. By non-tackiness is meant that uncharged toner particles can be easily removed from the surface by wiping, for example, with a soft cloth or with an air jet.
5. A triboelectric interaction with the toner particles in order to allow the toner particles to acquire the desired charge polarity.
6. Coatings relatively insensitive to relative humidities of from 20 percent at 60° F., to 80 percent at 80° F.

Particularly preferred coatings selected for use in the present invention include the silicone resins Dow Corning 804 and 840, chlorotrifluoroethylene vinyl chloride copolymer, and styrene butadiene resins.

Generally, the carbon black which is contained in the overocating, or added thereto, is present in an amount ranging from about 0.125 percent by weight to about 10 percent by weight, thus carbon black being present primarily for the purpose of increasing the conductivity of the surface of the toner transporting means to about $10^6$ to $10^{10}$ ohm-cm. Moreover, silica and other particulate fillers can also be incorporated into the coatings of the present invention in an amount of from about 3 percent by weight to about 10 percent by weight for the purpose of creating the desired surface texture. Examples of preferred fillers are Syloid® silicas (Davison Chemical Division of W. R. Grace & Company); amorphous silicas (Illinois Minerals Company); air floated amorphous silicas (Illinois Minerals Company); calcined aluminum silicate (Engelhard Minerals & Chemicals corporation); calcium metasilicates (NYCO); particulate metallic stearates (Witco Chemical Corporation, Mallinckrodt, Inc.); and particular polymeric resins. These particulate fillers, which are added to the transporting means appear as protuberances in the coatings, which protuberances can be characterized in terms of height and frequency by a surface profilometer.

The coating is present on the entire outer surface of the transporting toner means, and generally is present in a thickness of from about 2 micrometers to about 126 micrometers, and preferably is present in a thickness of from about 10 micrometers to about 50 micrometers. Coating thicknesses outside the ranges specified may be useful providing the objectives of the present invention are accomplished. Also, the coating can be applied by numerous known methods including, for example, spray coating, dip coating, Myer rod, draw bar, electrostatic deposition, and the like.

The primary purpose of the coating of the present invention is to deliver well charged toner to the development nip. Advantages over many previously reported materials are cost, ease of handling, and simplicity of processing.

Illustrative examples of toner resin materials include, for example, polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl naphthalene, ethylenically unsaturated mono-olefins such as ethylene, propylene, butylene, isobutylene and the like; vinyl esters such as vinyl chloride, vinyl bromide, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate, and the like, acrylonitrile methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidine halides such as vinylidene chloride, vinylidene chlorofluoride and the like; and N-vinyl indole, N-vinyl pyrrolidene and the like; styrene butadiene copolymer resins; and mixtures thereof.

Also, esterification products of a dicarboxylic acid and a diol comprising a diphenol may be used as a preferred resin material for the toner composition of the present invention. These materials are illustrated in U.S. Pat. No. 3,655,374, the disclosure of which is totally incorporated herein by reference, the diphenol reactant being for the formula as shown in column 4, beginning at line 5 of this patent; and the dicarboxylic acid being of the formula as shown in column 6 of the above patent. The resin is present in an amount so that the total of all ingredients used in the toner total about 100 percent, thus when 5 percent by weight of a charge enhancing additive is present, and 10 percent by weight of a pigment such as carbon black is present, about 85 percent by weight of resin material is used.

The toner resin particles can vary in diameter, but generally are from about 5 micrometers to about 30 micrometers in diameter, and preferably from about 10 micrometers to about 20 micrometers.

Various suitable pigments or dyes may be selected as the colorant for the toner particles, these materials being well known, and including for example, carbon black, nigrosine dye, calico oil blue, chrome yellow, ultramarine blue, duPont oil red, methylene blue chloride, phthalocyanine blue and mixtures thereof. The pigment or dye should be present in a sufficient quantity to render the toner highly colored enabling the formation of a clearly visible image on the recording member. For example, when conventional xerographic copies of documents are desired, the toner may include a black pigment such as carbon black, or the black dye Amaplast available from the National Aniline Products Inc. Preferably, the pigment is present in amounts of from about 3 percent to about 20 percent by weight, based on the total weight of the toner; however, if the colorant selected is a dye, substantially small quantities of the color may be used.

Also, there can be incorporated in the toner composition various enhancing additives primarily for the purpose of imparting a positive charge to the toner resin. Examples of these additives include quaternary ammonium compounds, organic sulfonates, reference U.S. Pat. No. 4,338,390, the disclosure of which is incorporated herein by reference; and alkyl pyridinium halides inclusive of cetyl pyridinium chloride, cetyl pyridinium tosylate, and the like.

The following examples are being supplied to further define certain embodiments of the present invention, it being noted that these examples are intended to be illustrative only, and are not intended to limit the scope of the present invention. Parts and percentages are by weight unless otherwise indicated.

EXAMPLE I

There was prepared a donor transporting means by coating on a nickel sleeve a mixture of 20 grams of vinyl chloride/chlorotrifluoroethylene (FPC 461), one gram of Vulcan carbon black, and Syloid ® 161 silica, available from Davison Chemical Company, a division of W. R. Grace Company, 1 gram, in the following manner:

One hundred and fifty grams (150), of an acrylic lacquer thinner, available from Martin Senour Company as number 3092, was mixed with the above materials on a paint shaker for about 30 minutes. The resulting mixture was then spray coated on a nickel sleeve to a thickness of 25 micrometers, followed by the curing of the resulting device in air, which curing was affected at a temperature of 80° C. for 20 minutes. The resulting device was then removed from the oven and allowed to cool to room temperature. The resulting nickel sleeve coated in a thickness of 25 micrometers of FPC 461, carbon black, silica mixture, was then incorporated as the transporting donor belt 18 in the device illustrated in FIG. 2; and prints of acceptable image quality, substantially no background, and resolution were generated. The toner used was comprised of composition with 94 percent by weight of a styrene n-butylmethacrylate copolymer resin, 58 percent resin, 58 percent by weight of styrene and 42 percent by weight of n-butyl methacrylate, and 6 percent by weight of Regal® 330 carbon black. Another toner used contained 94 percent by weight of a styrene terpolymer with about 58 percent by weight of styrene, 21 percent by weight of methylmethacrylate, and 20 percent by weight of 2-ethylhexylmethacrylate; 5 percent by weight of carbon black, and as the charge enhancing additive 2 percent by weight of (3-lauramidopropyl) trimethyl ammonium methylsulfate.

EXAMPLE II

There was prepared a toner transporting means by coating a nickel sleeve in accordance with the process Example I, with the exception that there were used as the coating mixture 20 grams of a styrene butadiene copolymer 91/9, available from Goodyear Tire and Rubber Company, Chemical Division, 1.2 grams of carbon black, and 1.4 grams of the silica Syloid 169. Curing was then accomplished at 80° C. for 20 minutes. The resulting transporting member was then incorporated into the imaging test fixture of FIG. 1, wherein it transported a charged layer of toner particles. The toner particles selected contained 94.25 percent by weight of a styrene butadiene copolymer, 91 percent by weight styrene and 9 percent by weight butadiene; 6 percent by weight Regal® 330 carbon black, and 0.75 percent of the charge enhancing additive cetyl pyridinium tetrafluoroborate.

EXAMPLE III

There was prepared a toner transporting means by coating a nickel sleeve in accordance with the process of Example I, with the exception that there was initially applied to the sleeve a primer coat of Dow Corning compound 1205, following by air drying for 5 minutes. Thereafter, an overcoating mixture of 33 grams of the silicone resin 804 available from Dow Corning, as a 60 percent solids solution, 1 gram of carbon black; and 1.4 grams of the silica, Syloid R 169, was applied to the primer, followed by curing at 180° C. for 1 hour. The resulting sleeve was then incorporated into the imaging test fixture of FIG. 1, wherein it transported a layer of charged toner particles. The toner composition selected contained 92 percent by weight styrene n-butylmethacrylate copolymer resin, 58 percent by weight of styrene and 41 percent by weight n-butylmethacrylate, 6 percent by weight Regal® 330 carbon black, and 2 percent by weight of the charge enhancing additive stearyl phenethyl dimethyl ammonium tosylate.

Other modifications of the present invention will occur to those skilled in the art based upon a reading of the present disclosure. These are intended to be included within the scope of this invention.

What is claimed is:

1. An apparatus for charging insulating toner particles comprised, in operative relationship, of a means for charging insulating toner particles and a means for transporting insulating toner particles, said means for charging and said means for transporting biased to a predetermined potential wherein the transporting means contains thereover a coating comprised of silicone resins with conductive particulate particles therein, and wherein the means for charging contains thereover a triboelectrically active coating selected from the group consisting of copolymers of chlorotrifluoroethylene and vinyl chloride, halogenated polymers, polyvinylpyridines, terpolymers of methacrylate, silane terpolymers, and polycaprolactum.

2. An apparatus in accordance with claim 1 wherein the coating is present on the entire outer surface of the transporting means in a thickness of from about 2 micrometers to about 125 micrometers.

3. An apparatus in accordance with claim 1 wherein the conductive particles are carbon black.

4. An apparatus in accordance with claim 1 wherein the coating is textured.

5. An apparatus in accordance with claim 4 wherein the texturing agent is silica.

6. An apparatus in accordance with claim 1 wherein the coating is deposited on a metallic substrate.

7. An apparatus in accordance with claim 6 wherein the metallic substrate is electroformed nickel.

8. An apparatus in accordance with claim 1 wherein the coating is deposited on a polymeric composition.

9. An apparatus in accordance with claim 1 wherein there is further included a means for imaging comprised of an inorganic, or organic photoconductive composition.

10. An apparatus in accordance with claim 9 wherein the inorganic composition is selenium, and the organic composition is comprised of a substrate, a charge generating layer and a charge transport layer.

11. An apparatus in accordance with claim 1 wherein the halogenated polymers are polyvinylidine fluoride, polytetrafluoroethylenes, perfluoroalkoxylated ethylenes, fluorinated ethylene propylene, polytetrafluoroethylene copolymers, or polyvinyl chloride.

12. An apparatus in accordance with claim 1 wherein the terpolymers and methacrylates are polymethylmethacrylates or polystyrene/n-butylmethacrylate.

13. An apparatus in accordance with claim 1 wherein the conductivity of the surface of the means for transporting is from about $10^6$ to about $10^{10}$ ohm-cm.

14. An apparatus for simultaneously metering and charging nonmagnetic insulating toner particles comprising, in operative relationship, a metering/charging roll means; a triboelectrically active coating present on the metering/charging roll means; a doctor blade means for the metering/charging roll means; a toner supply reservoir means containing therein weakly charged insulating toner particles comprised of about an equal number of positively charged toner particles and negatively charged toner particles; a transport toner donor means comprised of a nickel sleeve with a coating thereover comprised of silicone resins with conductive particulate particles therein with a coating thickness of from about 2 micrometers to about 125 micrometers; a voltage source means for the metering/charging means; a voltage source means for the nickel sleeve means, the metering/charging roll means moving in a direction opposite to the direction of movement of the transport donor sleeve means.

15. An apparatus in accordance with claim 14 wherein the triboelectrically active coating for the metering/charging roll means is selected from the group consisting of copolymers of chlorotrifluoroethylene and vinyl chloride, halogenated polymers, polyvinylpyridines, terpolymers of methacrylate, silane terpolymers, and polycaprolactum.

16. An apparatus in accordance with claim 15 wherein the halogenated polymers are polyvinylidine fluoride, polytetrafluoroethylenes, perfluoroalkoxylated ethylenes, fluorinated ethylene propylene, polytetrafluoroethylene copolymers, or polyvinyl chloride.

* * * * *